US009731400B2

(12) United States Patent
Tsuno

(10) Patent No.: US 9,731,400 B2
(45) Date of Patent: Aug. 15, 2017

(54) GRINDING WHEEL AND CLEANING METHOD FOR GRINDING CHAMBER

(71) Applicant: DISCO CORPORATION, Tokyo (JP)

(72) Inventor: Takahiko Tsuno, Tokyo (JP)

(73) Assignee: Disco Corporation, Tokyo (JP)

( * ) Notice: Subject to any disclaimer, the term of this patent is extended or adjusted under 35 U.S.C. 154(b) by 43 days.

(21) Appl. No.: 14/662,491

(22) Filed: Mar. 19, 2015

(65) Prior Publication Data

US 2015/0283670 A1 Oct. 8, 2015

(30) Foreign Application Priority Data

Apr. 4, 2014 (JP) ..... 2014-077996

(51) Int. Cl.

| | |
|---|---|
| ***B08B 3/02*** | (2006.01) |
| ***B08B 9/00*** | (2006.01) |
| ***B08B 9/093*** | (2006.01) |
| ***B08B 1/00*** | (2006.01) |
| ***B24B 53/007*** | (2006.01) |
| ***B24D 7/18*** | (2006.01) |

(52) U.S. Cl.

CPC ..... *B24B 53/007* (2013.01); *B08B 3/02* (2013.01); *B08B 9/00* (2013.01); *B24D 7/18* (2013.01); *B08B 1/007* (2013.01); *B08B 9/093* (2013.01)

(58) Field of Classification Search

None

See application file for complete search history.

(56) References Cited

U.S. PATENT DOCUMENTS 6,066,562 A * 5/2000 Ohshima ..... B24B 7/228 125/11.01
2009/0098808 A1* 4/2009 Kajiyama ..... B24B 1/00 451/41

FOREIGN PATENT DOCUMENTS

JP 2007296601 A * 11/2007
JP 2013-141738 7/2013

OTHER PUBLICATIONS

English Machine Translation of JP 2007-296601.*

* cited by examiner

*Primary Examiner* — Nicole Blan
(74) *Attorney, Agent, or Firm* — Greer Burns & Crain Ltd.

(57) ABSTRACT

A grinding wheel includes an annular base and a plurality of abrasive members fixed to the lower surface of the base and arranged annularly. The base has a plurality of through holes for discharging a grinding water. The plural through holes radially extend from the inner side surface to the outer side surface of the base. The plural through holes are arranged at given intervals in the circumferential direction of the base so that the grinding water is scattered in different directions from the through holes.

1 Claim, 5 Drawing Sheets

GRINDING WHEEL AND CLEANING METHOD FOR GRINDING CHAMBER

BACKGROUND OF THE INVENTION

Field of the Invention

The present invention relates to a grinding wheel for use in a grinding apparatus for grinding a workpiece such as a semiconductor wafer and also to a cleaning method for a grinding chamber included in the grinding apparatus.

Description of the Related Art

In a grinding apparatus, grinding is conventionally performed in the condition where a grinding water is supplied. The grinding water is supplied along the inner circumferential surface of a grinding wheel having plural abrasive members (see Japanese Patent Laid-open No. 2013-141738, for example). In the grinding apparatus described in Japanese Patent Laid-open No. 2013-141738, the grinding wheel has an annular base, and the plural abrasive members are mounted on the lower surface of the base so as to be spaced at given intervals in the circumferential direction of the base. The grinding water flows along the inner circumferential surface (inner side surface) of the base toward the abrasive members and then enters the spacing between the grinding surface of each abrasive member and the work surface of the workpiece during grinding. A grinding dust is generated during grinding and it is contained in the grinding water. The grinding water thus containing the grinding dust is forcibly moved toward the outer circumference of the workpiece through the gap between any adjacent ones of the abrasive members by a centrifugal force of the like.

SUMMARY OF THE INVENTION

The grinding wheel and a holding table for holding the workpiece are provided in a grinding chamber included in the grinding apparatus. During grinding, the grinding water containing the grinding dust is scattered in the grinding chamber due to the rotation of the grinding wheel and the holding table, so that the grinding water containing the grinding dust sticks to the inner wall of the grinding chamber. Furthermore, the grinding water containing the grinding dust is bounced from the upper surface (work surface) of the workpiece to form a mist, which floats in the grinding chamber and sticks to the inner wall of the grinding chamber. There is a possibility that the grinding water containing the grinding dust may drop from the inner wall of the grinding chamber onto the upper surface of the workpiece. In the case that the grinding dust is a large grinding dust generated during rough grinding, there is a possibility that finish grinding may be performed in the condition where this large grinding dust has dropped on the upper surface of the workpiece, causing a problem such that abrasive members for finish grinding may be damaged.

Further, when the grinding water containing the grinding dust sticks to the inner wall of the grinding chamber and this condition is allowed to stand for a long time, the particles of the grinding dust contained in the grinding water may be combined with each other to form a large grinding dust. As a result, the large grinding dust may drop by gravity from the inner wall of the grinding chamber to the upper surface of the workpiece, causing damage to the workpiece or the abrasive members.

It is therefore an object of the present invention to provide a grinding wheel and a cleaning method for a grinding chamber which can prevent the adhesion of the grinding dust to the work surface of the workpiece.

In accordance with an aspect of the present invention, there is provided a grinding wheel adapted to be mounted on a wheel mount connected to a spindle having a rotational axis extending in a vertical direction to grind a workpiece, the grinding wheel including: an annular base having an upper surface as a mounted surface to be mounted on a mounting surface of the wheel mount, a lower surface formed below the upper surface and adapted to be opposed to the workpiece, an inner side surface connecting the inner end of the upper surface and the inner end of the lower surface, and an outer side surface connecting the outer end of the upper surface and the outer end of the lower surface; and a plurality of abrasive members fixed to the lower surface of the annular base and arranged annularly for grinding the workpiece; the annular base having a plurality of through holes for discharging a grinding water, the plurality of through holes radially extending from the inner side surface to the outer side surface of the base; the through holes being arranged at given intervals in the circumferential direction of the base so that the grinding water is scattered in different directions from the through holes.

With this configuration, a part of the grinding water supplied toward the abrasive members is guided along the inner side surface of the base and introduced into the through holes formed in the base by a centrifugal force due to the rotation of the grinding wheel. The grinding water introduced into the through holes is passed through the through holes and then discharged from the outer side surface of the base by the centrifugal force. Accordingly, the grinding water is scattered from the through holes toward a top plate and a side plate forming the grinding chamber, thereby washing away a grinding dust sticking to the top plate and the side plate of the grinding chamber. As a result, it is possible to prevent that the grinding dust sticking to the top plate and the side plate of the grinding chamber may drop onto the upper surface of the workpiece. Further, the grinding water can be scattered in different directions from the plural through holes, so that the grinding water scattered can clean a wide area in the grinding chamber to thereby improve the cleaning efficiency for the grinding chamber.

In accordance with another aspect of the present invention, there is provided a cleaning method for a grinding chamber in a grinding apparatus including holding means for holding a workpiece and grinding means having a rotatable grinding wheel, the grinding wheel being composed of an annular base having an inner side surface and an outer side surface and a plurality of abrasive members fixed to the base and arranged annularly for grinding the workpiece held on the holding means, the holding means and the grinding means being provided in the grinding chamber, the cleaning method including: a grinding water supplying step of supplying a grinding water at given flow rate from grinding water supplying means to the inner side surface of the base of the grinding wheel in the condition where the grinding wheel is being rotated; and a grinding chamber cleaning step of guiding the grinding water supplied by the grinding water supplying step along the inner side surface of the base to the abrasive members, introducing a part of the grinding water into a plurality of through holes formed in the base so as to extend from the inner side surface to the outer side surface, by using a centrifugal force due to the rotation of the grinding wheel, and then scattering the grinding water from the through holes opening to the outer side surface, thereby cleaning the grinding chamber with the grinding water scattered.

With this configuration, the grinding water is scattered from the through holes of the grinding wheel to thereby clean the grinding chamber, thereby preventing the adhesion of the grinding dust to the work surface of the workpiece.

The above and other objects, features and advantages of the present invention and the manner of realizing them will become more apparent, and the invention itself will best be understood from a study of the following description and appended claims with reference to the attached drawings showing some preferred embodiments of the invention.

DETAILED DESCRIPTION OF THE PREFERRED EMBODIMENTS

Figure 1A:
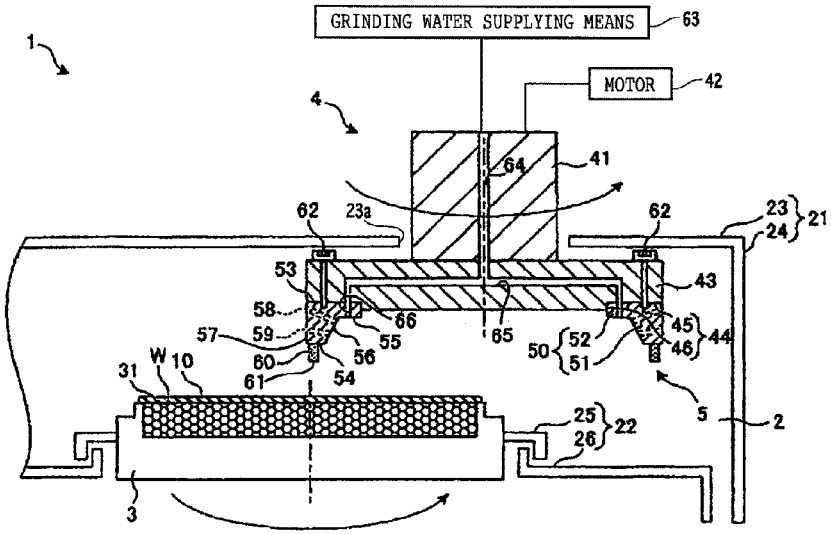
FIG. 1A is a schematic sectional view of a grinding apparatus according to a first preferred embodiment of the present invention.
Figure 1B:
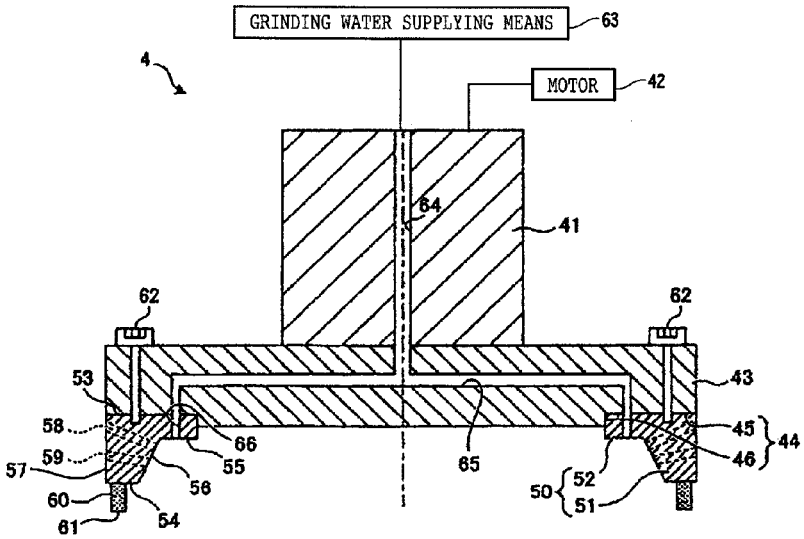
FIG. 1B is a schematic sectional view of grinding means included in the grinding apparatus shown in FIG. 1A.

There will now be described a grinding apparatus according to a first preferred embodiment of the present invention with reference to FIGS. 1A and 1B. FIG. 1A is a schematic sectional view of the grinding apparatus according to the first preferred embodiment, and FIG. 1B is a schematic sectional view of grinding means included in the grinding apparatus shown in FIG. 1A. The configuration of the grinding apparatus according to the present invention is not limited to that shown in these drawings, but any configuration capable of grinding a workpiece with abrasive members may be adopted.

Referring to FIG. 1A, the grinding apparatus generally denoted by reference numeral 1 includes a holding table 3 (holding means) for holding a workpiece W and grinding means 4 having a grinding wheel 5 with a plurality of abrasive members 60 for grinding the workpiece W held on the holding table 3, wherein the holding table 3 is vertically opposed to the grinding means 4. Each abrasive member 60 has a grinding surface 61 adapted to come into contact with the upper surface 10 (work surface) of the workpiece W held on the holding table 3, thereby grinding the workpiece W. Further, the grinding apparatus 1 is configured in such a manner that a grinding water to be supplied to the abrasive members 60 is scattered to the outside of the grinding wheel 5, thereby cleaning a grinding chamber 2.

In the condition where the holding table 3 is located below the grinding means 4 so as to be opposed thereto as shown in FIG. 1A, the grinding chamber 2 is defined by a cover member. This cover member is composed of an upper cover 21 for covering the upper and side areas of the grinding means 4 and a lower cover 22 for covering the periphery of the holding table 3. The upper cover 21 includes a top plate 23 extending horizontally and a side plate 24 extending downward from one end of the top plate 23. The top plate 23 has an opening 23*a* from which a part (spindle 41) of the grinding means 4 projects upward. The lower cover 22 is composed of a peripheral cover 25 fixed to the outer circumference of the holding table 3 and a waterproof cover 26 extending horizontally below the peripheral cover 25. The grinding chamber 2 is configured in such a manner that the grinding water containing a grinding dust generated during grinding does not splash out of the grinding apparatus 1 and that this grinding water can be drained from a predetermined position.

In the first preferred embodiment, examples of the workpiece W to be ground include a semiconductor wafer formed of a semiconductor material such as silicon and GaAs and an inorganic material wafer formed of an inorganic material such as ceramic, glass, and sapphire. Further, the workpiece W may be formed of various work materials required to have a TTV (Total Thickness Variation) on the order of micrometers to submicrometers.

The holding table 3 is a disk-shaped member, and it is rotatably provided on a base (not shown). The holding table 3 has an upper surface functioning as a holding surface 31 for holding the workpiece W under suction. The holding surface 31 is formed of a porous ceramic material. While the holding surface 31 is shown as a flat surface in FIG. 1A, the holding surface 31 is actually formed as a gently inclined conical surface having an apex coinciding with the center of rotation of the holding table 3. Accordingly, when the workpiece W is held on the holding surface 31 under suction, the workpiece W such as a wafer having a small thickness is deformed into a gently inclined conical shape following the shape of the holding surface 31.

The grinding means 4 includes the spindle 41 having a rotational axis extending vertically, a wheel mount 43 connected to the lower end of the spindle 41, and the grinding wheel 5 mounted on the lower surface of the wheel mount 43. The spindle 41 is rotationally driven by a motor 42. The wheel mount 43 is fixed to the lower end of the spindle 41. The grinding wheel 5 is detachably mounted on the wheel mount 43. The grinding means 4 is vertically movable by elevating means (not shown) toward or away from the holding table 3.

The wheel mount 43 is a disk-shaped member, and an annular recessed portion 44 is formed on the lower surface of the wheel mount 43 along the outer circumference thereof, wherein an annular base 50 constituting the grinding wheel 5 is fitted in the annular recessed portion 44. The recessed portion 44 has a flat surface 45 as a mounting surface for mounting the base 50 and a cylindrical side surface 46 as a positioning surface for radially positioning the base 50.

The plural abrasive members 60 constituting the grinding wheel 5 are fixed to the lower surface 54 of the annular base 50 so as to be annularly arranged. The annular base 50 is composed of an outer portion 51 and an inner portion 52 having a thickness smaller than that of the outer portion 51. The annular base 50 has an upper surface 53 as a mounted surface to be mounted on the wheel mount 43. Further, the outer portion 51 has a lower surface 54 and the inner portion 52 has a lower surface 55 higher in level than the lower surface 54. The lower surface 54 of the outer portion 51 and the lower surface 55 of the inner portion 52 are connected to each other through an inner side surface 56 (conical surface) diverging from the lower surface 55 to the lower surface 54. This inner side surface 56 functions as an inclined surface for guiding the grinding water to the abrasive members 60 as described later.

Each abrasive member 60 is formed by bonding alumina abrasive grains, silicon carbide abrasive grains, or superabrasive grains of CBN (Cubic Boron Nitride) or diamond, for example, with a bond such as resin bond and vitrified bond. In the condition shown in FIG. 1A, the abrasive members 60 are located above the holding table 3 so that each abrasive member 60 can pass through the position directly above the axis of rotation of the holding table 3. The grinding wheel 5 is fixed to the wheel mount 43 by tightening a plurality of screws 62 from the upper surface of the wheel mount 43 in the condition where the base 50 is fitted in the recessed portion 44 of the wheel mount 43.

A first passage 64 for supplying the grinding water is formed in the spindle 41 so as to extend vertically along the axis of rotation of the spindle 41. Grinding water supplying means 63 is connected to one end (upper end) of the first passage 64. A plurality of second passages 65 for supplying the grinding water are formed in the wheel mount 43 and connected to the lower end of the first passage 64. The second passages 65 extend horizontally from the center of the wheel mount 43 toward the outer circumference thereof in the radial direction of the wheel mount 43. The radially outer ends of the second passages 65 are bent downward at the positions above the base 50 and respectively connected to a plurality of third passages 66 formed in the base 50. Each third passage 66 is formed as a through hole extending from the upper surface 53 (mounted surface) of the base 50 to the lower surface 55 of the base 50 at the inner portion 52 thereof. These through holes as the third passages 66 are equally spaced in the circumferential direction of the base 50.

Further, the outer portion 51 of the base 50 is formed with a plurality of through holes 58 and 59 extending from the inner side surface 56 (inclined surface) to the outer side surface 57, wherein these plural through holes 58 and 59 are two kinds of through holes. The plural through holes 58 and 59 are equally spaced in the circumferential direction of the base 50 and alternately arranged. The through holes 58 are inclined upward from the inner side surface 56 to the outer side surface 57, whereas the through holes 59 are formed below the through holes 58 and inclined upward from the inner side surface 56 to the outer side surface 57 at an inclination angle smaller than that of the through holes 58.

In the condition where the grinding wheel 5 is being rotated during grinding, the grinding water is supplied at a predetermined flow rate from the grinding water supplying means 63. The grinding water is supplied through the first, second, and third passages 64, 65, and 66 to the abrasive members 60. At this time, a part of the grinding water is introduced into the plural through holes 58 and 59 formed in the base 50 by a centrifugal force due to the rotation of the grinding wheel 5 and next discharged (scattered) from the outer side surface 57 of the base 50 in a plurality of directions. This grinding water discharged from the outer side surface 57 of the base 50 is used as a cleaning water for cleaning the grinding chamber 2.

In the condition where the grinding water is being supplied to the grinding wheel 5, the grinding wheel 5 being rotated is lowered until the grinding surface 61 of each abrasive member 60 comes into contact with the upper surface 10 (work surface) of the workpiece W held on the holding table 3. By making the contact between the abrasive members 60 and the workpiece W, the workpiece W is ground by the abrasive members 60. At this time, the grinding dust generated during grinding is contained in the grinding water and forced to flow with the grinding water. Further, the grinding water containing the grinding dust also floats as a mist in the grinding chamber 2 and sticks to the top plate 23 and the side plate 24 of the grinding chamber 2. However, the clean grinding water directly supplied from the grinding water supplying means 63 is discharged from the plural through holes 58 and 59 formed in the base 50 in this preferred embodiment. Accordingly, the grinding dust sticking to the top plate 23 and the side plate 24 can be washed away by the clean grinding water, so that there is no possibility that the grinding dust may drop onto the upper surface of the workpiece W.

Figure 2A:
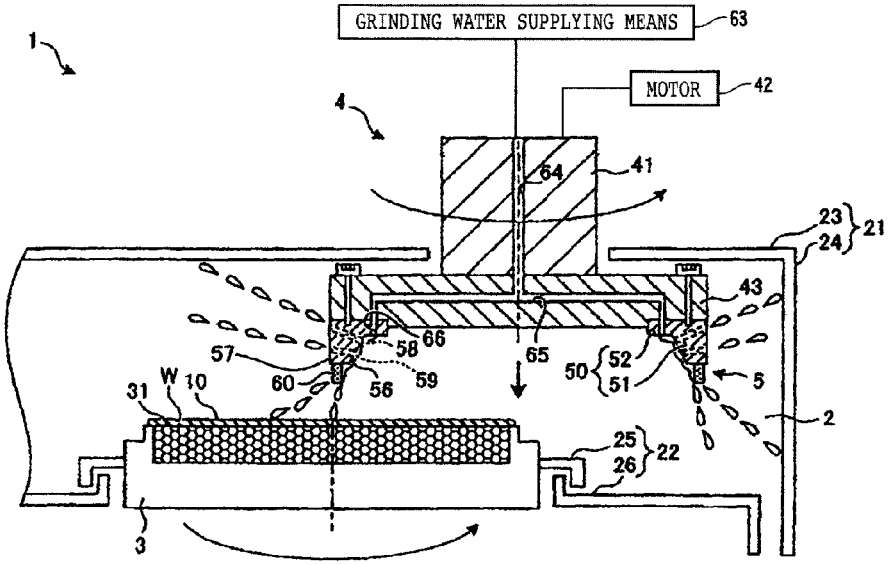
FIGS. 2A and 2B are schematic sectional views for illustrating the operation of the grinding apparatus according to the first preferred embodiment and the cleaning method for a grinding chamber included in the grinding apparatus shown in FIG. 1A.
Figure 2B:
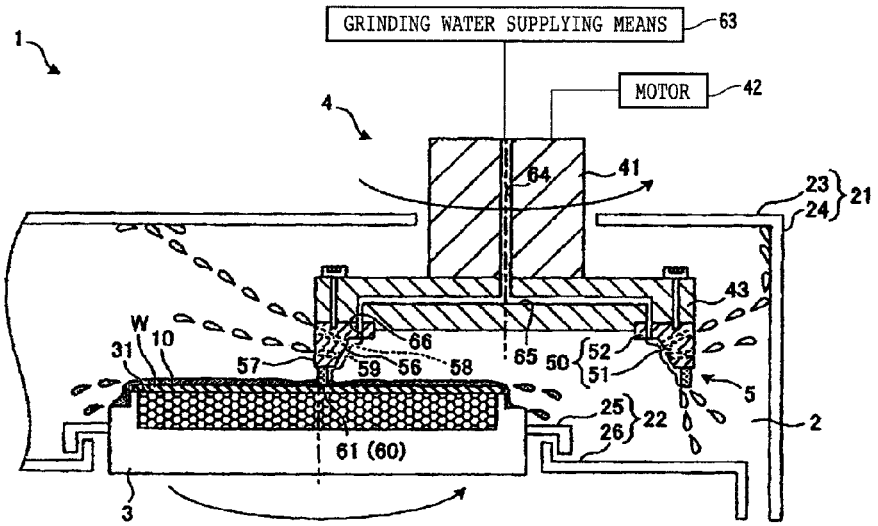
Figure 3A:
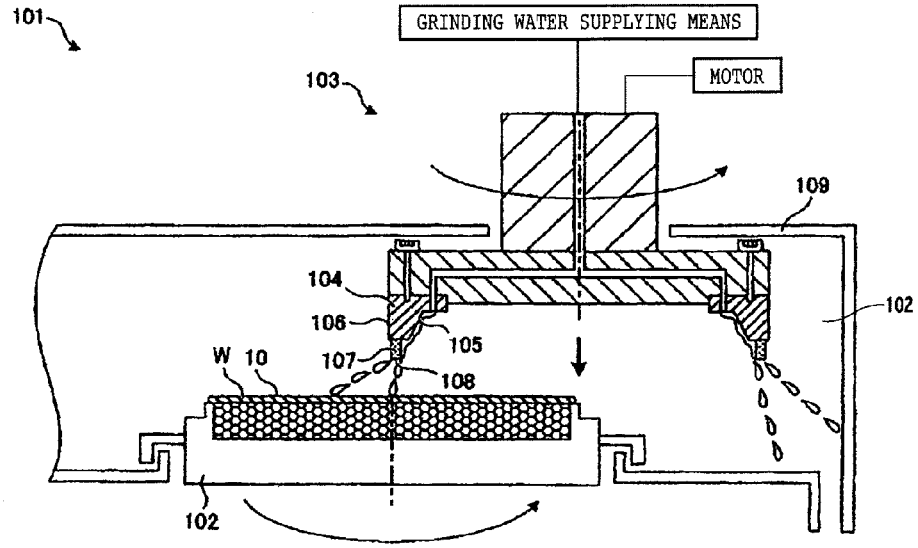
FIG.3A PRIOR ART
FIGS. 3A and 3B are schematic sectional views for illustrating the operation of a grinding apparatus according to a comparison.
Figure 3B:
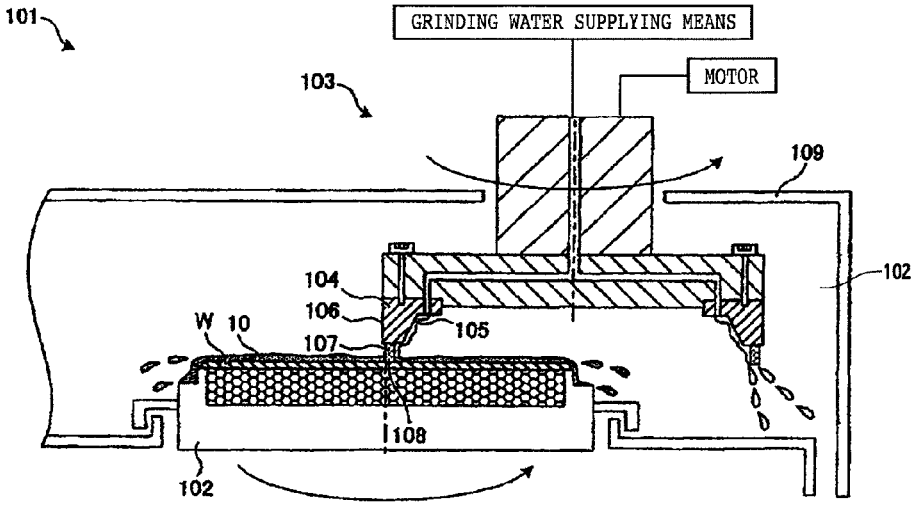
FIG.3B PRIOR ART

The operation of the grinding apparatus 1 according to the first preferred embodiment and the cleaning method for the grinding chamber 2 will now be described by using a comparison with reference to FIGS. 2A and 2B and FIGS. 3A and 3B. FIGS. 2A and 2B are schematic sectional views for illustrating the operation of the grinding apparatus 1 according to the first preferred embodiment and the cleaning method for the grinding chamber 2, wherein FIG. 2A shows a condition before grinding and FIG. 2B shows a condition during grinding. FIGS. 3A and 3B are schematic sectional views for illustrating the operation of a grinding apparatus according to the comparison, wherein FIG. 3A shows a condition before grinding and FIG. 3B shows a condition during grinding. The comparison shown in FIGS. 3A and 3B is different from the first preferred embodiment shown in FIGS. 2A and 2B in the point that the two kinds of through holes 58 and 59 are not formed in the base of a grinding wheel in the comparison.

The operation of the grinding apparatus 1 according to the first preferred embodiment will now be described. As shown in FIG. 2A, the grinding water is supplied from the grinding water supplying means 63 to the grinding means 4 in the condition where the grinding wheel 5 is being rotated before grinding (grinding water supplying step). The grinding water is supplied through the first, second, and third passages 64, 65, and 66 to the inner portion 52 of the base 50 and next guided along the inner side surface 56 to reach the abrasive members 60. Since the grinding wheel 5 is being rotated, the grinding water supplied to the abrasive members 60 is splashed obliquely downward toward the outside of the abrasive members 60 by a centrifugal force. Accordingly, the holding table 3, the lower cover 22, the side plate 24, etc. located below the grinding means 4 can be cleaned by the clean grinding water before grinding.

Further, a part of the grinding water flowing downward on the inner side surface 56 is introduced into the plural through holes 58 and 59 formed in the outer portion 51 of the base 50. The grinding water introduced into the plural through holes 58 and 59 is allowed to flow obliquely upward owing to the centrifugal force in the through holes 58 and 59 from the inner side surface 56 to the outer side surface 57 of the base 50. Thereafter, the grinding water is discharged from the outer side surface 57 of the base 50 toward the outside of the grinding wheel 5 (grinding chamber cleaning step). In this case, the rotational speed of the grinding wheel 5 is adjusted so that the grinding water can flow obliquely upward in the upward inclined through holes 58 and 59 toward the outer side surface 57. In other words, the component of the centrifugal force with respect to the directions of extension of the through holes 58 and 59 is larger than the component of the gravity acting on the grinding water with respect to the directions of extension of the through holes 58 and 59.

The inclination angle of the through holes 58 is different from the inclination angle of the through holes 59, and the outlets of the through holes 58 and 59 are formed at different positions on the outer side surface 57. Accordingly, the grinding water discharged from the outer side surface 57 is scattered at different angles. As a result, the grinding water can be widely scattered around the grinding means 4. The grinding water thus scattered strikes the upper cover 21 to wash away the grinding dust or the like sticking to the top plate 23 and the side plate 24. In this manner, the grinding water supplied to the grinding means 4 is used as a cleaning water for cleaning the grinding chamber 2 before grinding. By suitably changing the inclination angle, diameter, etc. of the through holes 58 and 59, it is possible to freely adjust the flow rate, discharge direction, discharge distance, discharge speed, etc. of the grinding water to be scattered from the through holes 58 and 59.

When the grinding wheel 5 is lowered from the condition shown in FIG. 2A, the grinding surface 61 of each abrasive member 60 comes into contact with the upper surface 10 (work surface) of the workpiece W in the condition where both the grinding wheel 5 and the holding table 3 are being rotated, thereby grinding the workpiece W. The grinding dust generated during grinding is contained in the grinding water supplied along the abrasive members 60 to the workpiece W, and the grinding water thus containing the grinding dust is forced to flow radially outward on the upper surface 10 of the workpiece W. Thereafter, the grinding water containing the grinding dust is scattered from the outer circumference of the holding table 3 toward the lower cover 22. Further, a part of the grinding water containing the grinding dust is bounced from the workpiece W to form a mist, which floats in the grinding chamber 2.

As in the condition shown in FIG. 2A, the clean grinding water is discharged from the plural through holes 58 and 59 toward the outside of the grinding wheel 5 during grinding as shown in FIG. 2B. Accordingly, even when the grinding dust sticks to the top plate 23 and the side plate 24 of the grinding chamber 2, the grinding dust can be washed away by the grinding water discharged from the through holes 58 and 59. As a result, the grinding chamber 2 can be kept clean and it is possible to prevent that the grinding dust may drop from the top plate 23 to the upper surface 10 of the workpiece W. The vertical positions (heights) of the inlets of the plural through holes 58 and 59 opening to the inner side surface 56 of the base 50 are set so that the grinding water containing the grinding dust (see the hatched part of the grinding water shown in FIG. 2B) does not enter the inlets of the through holes 58 and 59 after rising along the abrasive members 60 and the inner side surface 56 of the base 50. Accordingly, only the clean grinding water (pure water) not containing the grinding dust is allowed to enter the inlets of the through holes 58 and 59. As a result, the grinding chamber 2 can be cleaned by only the clean grinding water.

In the first preferred embodiment, the grinding water supplying step is defined as the step of supplying the grinding water from the grinding water supplying means 63 to the grinding means 4 in the condition where the grinding wheel 5 is being rotated. Further, the grinding chamber cleaning step is defined as the step of supplying the grinding water along the inner side surface 56 of the base 50 to the abrasive members 60, introducing a part of this grinding water into the through holes 58 and 59 from their inlets opening to the inner side surface 56, and then discharging the grinding water from the outlets of the through holes 58 and 59 opening to the outer side surface 57, thereby cleaning the grinding chamber 2. In the cleaning method for the grinding chamber 2 according to the first preferred embodiment, the cleaning chamber 2 can be cleaned by both the grinding water supplying step and the grinding chamber cleaning step.

The cleaning step for the grinding chamber 2 according to the first preferred embodiment may be performed before grinding or may be performed during grinding. In the case of performing the cleaning step for the grinding chamber 2 before grinding, the grinding dust or the like left on the inner wall of the grinding chamber 2 can be washed away by the grinding water to thereby prevent the adhesion of the grinding dust to the upper surface 10 of the workpiece W. In the case of performing the cleaning step for the grinding chamber 2 during grinding, the grinding dust generated during grinding can be washed away by the grinding water to thereby maintain the grinding chamber 2 in a clean condition. Further, the cleaning step for the grinding chamber 2 may be performed in the condition where the workpiece W is not held on the holding table 3. In this case, the holding surface 31 of the holding table 3 can be cleaned to thereby prevent the entry of the grinding dust between the holding surface 31 and the workpiece W. Accordingly, there is no possibility of damage to the workpiece W due to the grinding dust.

The grinding apparatus according to the comparison shown in FIGS. 3A and 3B will now be described. As shown in FIG. 3A, the grinding apparatus generally denoted by reference numeral 101 is different from the grinding apparatus 1 shown in FIG. 1A in the point that no through holes are formed in a base 104 so as to extend from an inner side surface 105 to an outer side surface 106. Accordingly, a grinding water supplied to grinding means 103 is guided along the inner side surface 105 to abrasive members 107 and then only splashed obliquely downward from the abrasive members 107, so that an upper cover 109 cannot be cleaned by the grinding water.

When the grinding means 103 is lowered as shown in FIG. 3B, the abrasive members 107 come into contact with the workpiece W held on a holding table 102, thereby grinding the workpiece W. As described above with reference to FIG. 2B, the grinding dust generated during grinding is contained in the grinding water and then forced to flow away from the upper surface 10 of the workpiece W together with the grinding water. However, a part of the grinding water containing the grinding dust is bounced from the workpiece W to form a mist, which floats in a grinding chamber 102 and sticks to the upper cover 109. Since the upper cover 109 cannot be cleaned by the grinding water as described above, there is a possibility that the grinding dust sticking to the upper cover 109 may drop onto the upper surface 10 of the workpiece W, causing damage to the upper surface 10 of the workpiece W or a grinding surface 108 of each abrasive member 107.

To the contrary, the grinding apparatus 1 according to the first preferred embodiment includes the through holes 58 and 59 formed in the base 50 so as to extend from the inner side surface 56 to the outer side surface 57, so that the upper cover 21 forming the grinding chamber 2 can be cleaned by the grinding water discharged from the through holes 58 and 59. Accordingly, it is possible to prevent that the grinding dust may drop from the upper cover 21 to the upper surface 10 of the workpiece W.

In the grinding apparatus 1 according to the first preferred embodiment as described above, a part of the grinding water supplied toward the abrasive members 60 is guided along the inner side surface 56 of the base 50 and introduced into the through holes 58 and 59 by a centrifugal force due to the rotation of the grinding wheel 5. The grinding water introduced into the through holes 58 and 59 is discharged from the outer side surface 57 of the base 50. Accordingly, the grinding water passed through the through holes 58 and 59 is scattered into the grinding chamber 2 to thereby wash away the grinding dust sticking to the top plate 23 and the side plate 24 of the grinding chamber 2. As a result, it is possible to prevent that the grinding dust sticking to the top plate 23 and the side plate 24 may drop onto the upper surface 10 of the workpiece W. Further, the grinding water can be scattered in different directions from the plural through holes 58 and 59, so that the grinding water scattered can clean a wide area in the grinding chamber 2 to thereby improve the cleaning efficiency for the grinding chamber 2.

Figure 4A:
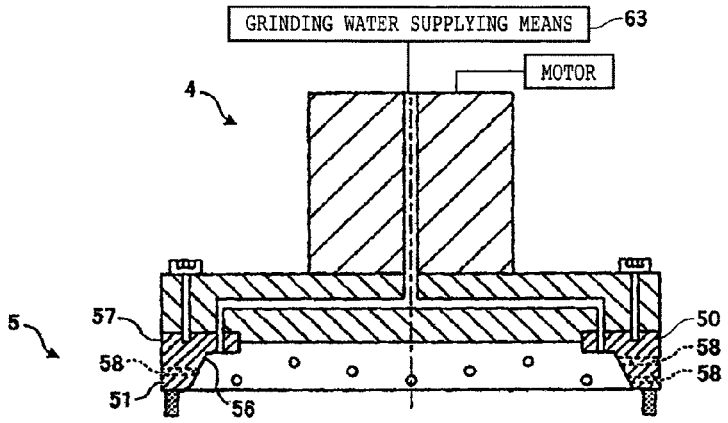
FIGS. 4A, 4B, and 4C are schematic sectional views showing various modifications of the grinding means according to the first preferred embodiment.
Figure 4B:
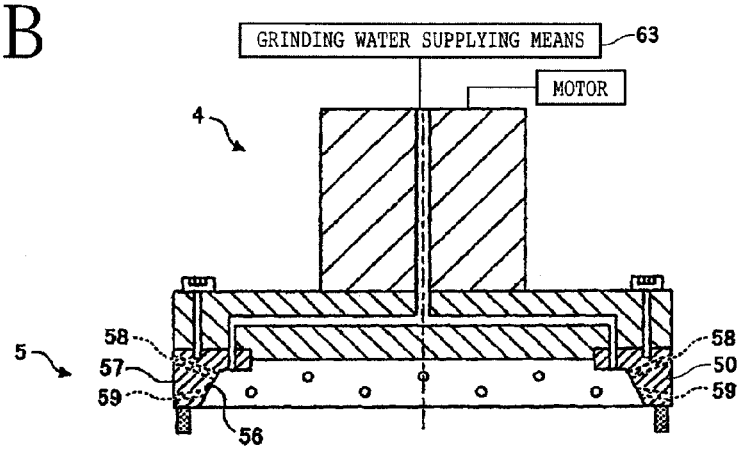
Figure 4C:
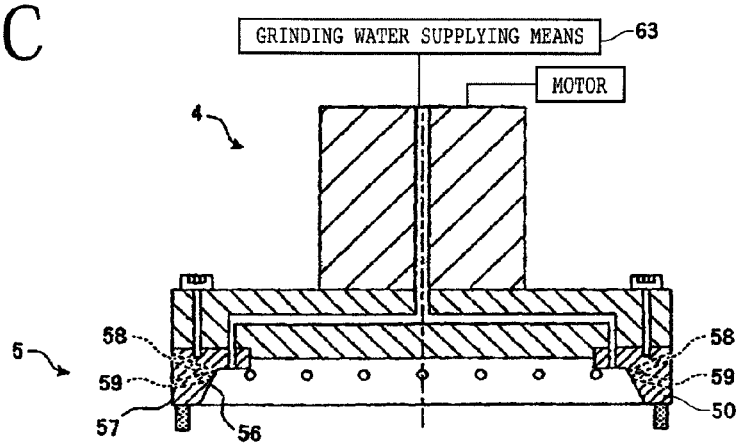

Various modifications of the through holes 58 and 59 formed in the base 50 will now be described with reference to FIGS. 4A, 4B, and 4C. FIG. 4A shows grinding means 4 according to a first modification, FIG. 4B shows grinding means 4 according to a second modification, and FIG. 4C shows grinding means 4 according to a third modification. In FIGS. 4A to 4C, the same parts as those of the first preferred embodiment shown in FIG. 1B are denoted by the same reference numerals. The modifications shown in FIGS. 4A to 4C are different from the first preferred embodiment shown in FIG. 1B in the direction of extension of the through holes. The following description will be focused on this different point.

As shown in FIG. 4A, the grinding means 4 according to the first modification includes a plurality of through holes 58 formed in the base 50 so as to horizontally extend from the inner side surface 56 to the outer side surface 57. These plural through holes 58 are equally spaced in the circumferential direction of the base 50. These plural through holes 58 are formed at three different heights and arranged so as to form a wave. With this arrangement, the grinding water as a cleaning water can be scattered horizontally at three different heights.

As shown in FIG. 4B, the grinding means 4 according to the second modification includes a plurality of through holes 58 and 59 formed in the base 50 so as to extend from the inner side surface 56 to the outer side surface 57, wherein these plural through holes 58 and 59 are two kinds of through holes. These plural through holes 58 and 59 are equally spaced in the circumferential direction of the base 50 and alternately arranged. The through holes 58 are inclined upward from the inner side surface 56 to the outer side surface 57. The through holes 59 are formed below the through holes 58 and inclined downward from the inner side surface 56 to the outer side surface 57. With this arrangement, the grinding water can be scattered to the outside of the grinding wheel 5 in an obliquely upward direction and in an obliquely downward direction.

As shown in FIG. 4C, the grinding means 4 according to the third modification includes a plurality of through holes 58 and 59 formed in the base 50 so as to extend from the inner side surface 56 to the outer side surface 57 as in the second modification. That is, these plural through holes 58 and 59 are equally spaced in the circumferential direction of the base 50 and alternately arranged. Furthermore, the upper through holes 58 are inclined upward from the inner side surface 56 to the outer side surface 57, whereas the lower through holes 59 are inclined downward from the inner side surface 56 to the outer side surface 57. With this arrangement, the grinding water can be scattered to the outside of the grinding wheel 5 in an obliquely upward direction and in an obliquely downward direction. However, in the third modification, the inlets of the through holes 58 and 59 opening to the inner side surface 56 are formed at the same height in an uppermost area on the inner side surface 56. Accordingly, the grinding water containing the grinding dust can be prevented from entering the inlets of the through holes 58 and 59 after rising along the inner side surface 56 during grinding. As a result, only the clean grinding water supplied from the grinding water supplying means 63 can be scattered from the through holes 58 and 59.

As described in the modifications shown in FIGS. 4A to 4C, the grinding water can be scattered to a desired position by suitably changing the position, number, inclination angle, etc. of the through holes 58 and 59. Accordingly, the cleaning area, range, etc. in the grinding chamber 2 can be freely adjusted according to the shape of the grinding chamber 2.

Figure 5:
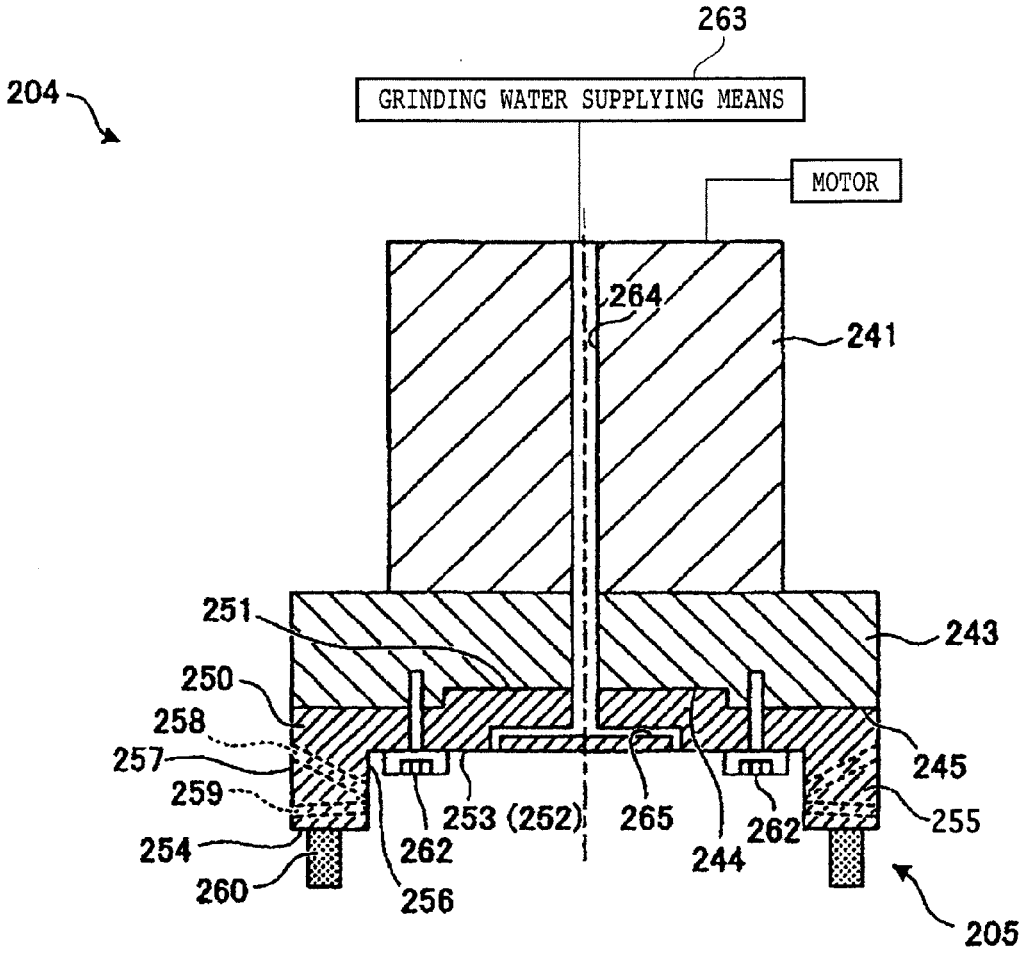
FIG. 5 is a schematic sectional view of grinding means according to a second preferred embodiment of the present invention.

There will now be described grinding means according to a second preferred embodiment of the present invention with reference to FIG. 5. FIG. 5 is a schematic sectional view of the grinding means according to the second preferred embodiment. The grinding means shown in FIG. 5 is grinding means for so-called TAIKO (registered trademark) grinding, wherein this grinding means is different from the grinding means according to the first preferred embodiment in the point that the outer diameter of a grinding wheel is smaller than the radius of a workpiece. The following description will be focused on this different point. The term of "TAIKO grinding" mentioned above means a grinding method such that the workpiece is ground except its peripheral area to thereby form an annular projection in this peripheral area. With this structure, the strength of the workpiece as a whole can be increased to thereby prevent the warpage of the workpiece and any trouble in handling the workpiece.

As shown in FIG. 5, the grinding means generally denoted by reference numeral 204 includes a spindle 241, a disk-shaped wheel mount 243 mounted on the lower end of the spindle 241, and a grinding wheel 205 mounted on the lower surface of the wheel mount 243. The grinding means 204 is vertically movable by elevating means (not shown) toward or away from a holding table (not shown). The grinding means 204 is also movable by horizontally moving means (not shown) in the radial direction of the holding table.

The wheel mount 243 is a disk-shaped member, and a circular recess 244 is formed on the lower surface of the wheel mount 243 at its central portion. Accordingly, the lower surface of the wheel mount 243 has an annular surface 245 around the circular recess 244. This annular surface 245 functions as a mounting surface for mounting the grinding wheel 205. The grinding wheel 205 is composed of a base 250 having a circular shape as viewed in plan and a plurality of abrasive members 260 fixed to the lower surface 254 of the base 250 at its peripheral portion. A circular projection 251 is formed on the upper surface of the base 250 at its central portion, and this circular projection 251 is fitted in the circular recess 244 of the wheel mount 243. The diameter of the circular projection 251 is slightly smaller than the diameter of the circular recess 244. By fitting the circular projection 251 in the circular recess 244, the base 250 is radially positioned with respect to the wheel mount 243.

A circular recess 252 is formed on the lower surface 254 of the base 250 at its central portion, wherein the diameter of the circular recess 252 is larger than the diameter of the circular projection 251. Accordingly, the lower surface of the base 250 has an annular surface 254 around the circular recess 252. This annular surface 254 functions as a mounting surface for mounting the plural abrasive members 260 in a ring fashion. In mounting the grinding wheel 5 to the wheel mount 243, the circular projection 251 of the base 250 is fitted in the circular recess 244 of the wheel mount 243, and a plurality of screws 262 are tightened from the bottom surface 253 (upper surface as viewed in FIG. 5) of the circular recess 252 of the base 250 into the wheel mount 243, thereby fixing the base 250 to the wheel mount 243.

A first passage 264 for supplying a grinding water is formed in the spindle 241 and the wheel mount 243 so as to extend vertically along the axis of rotation of the spindle 241. Grinding water supplying means 263 is connected to one end (upper end) of the first passage 264. A plurality of second passages 265 for supplying the grinding water are formed in the base 250 and connected to the lower end of the first passage 264. The second passages 265 extend horizontally from the center of the base 250 toward the outer circumference thereof in the radial direction of the base 250. The radially outward ends of the second passages 265 are bent downward at the positions radially inside the screws 262. The lower ends of the second passages 265 open to the bottom surface 253 of the circular recess 252 of the base 250.

The base 250 has a cylindrical inner side surface 256 formed by the circular recess 252 and an annular projection 255 formed around the circular recess 252. The annular projection 255 is formed with a plurality of through holes 258 and 259 extending from the inner side surface 256 to the outer side surface 257, wherein these plural through holes 258 and 259 are two kinds of through holes. The plural through holes 258 and 259 are equally spaced in the circumferential direction of the base 250 and alternately arranged. The through holes 258 are inclined upward from the inner side surface 256 to the outer side surface 257, whereas the through holes 259 are formed below the through holes 258 and inclined slightly downward from the inner side surface 256 to the outer side surface 257.

Also in the grinding means 204, the grinding water supplied from the grinding water supplying means 263 can be scattered in plural directions from the plural through holes 258 and 259 to the outside of the grinding wheel 205, thereby widely cleaning a grinding chamber (not shown). The TAIKO grinding is performed by the contact of the abrasive members 260 and a workpiece (not shown) in the condition where the grinding wheel 5 and the holding table holding the workpiece are rotated and the grinding means 204 is moved in the radial direction of the holding table.

The present invention is not limited to the above preferred embodiments, but various modifications may be made. The size, shape, etc. of the parts in the above preferred embodiments shown in the attached drawings are merely illustrative and they may be suitably changed within the scope where the effect of the present invention can be exhibited. Further, the above preferred embodiments may be suitably modified without departing from the scope of the object of the present invention.

For example, while the grinding water is discharged from the two kinds of through holes to the outside of the grinding wheel in the above preferred embodiments, the configuration of the through holes is not limited. That is, any kind of through holes capable of discharging the grinding water to the outside of the grinding wheel may be adopted. For example, one kind of through holes or three or more kinds of through holes may be adopted. Further, the shape and number of the through holes are not limited. Further, while the through holes for scattering the grinding water are formed in the base in the above preferred embodiments, the through holes may be formed in the grinding wheel.

In addition, while the inlets of the plural through holes 58 and 59 opening to the inner side surface 56 are formed at the same height in the modification shown in FIG. 4C, this configuration is merely illustrative. For example, the inlets of the plural through holes 58 and 59 opening to the inner side surface 56 may be formed at different heights and the outlets of the plural through holes 58 and 59 opening to the outer side surface 57 may be formed at the same height.

The present invention is not limited to the details of the above described preferred embodiments. The scope of the invention is defined by the appended claims and all changes and modifications as fall within the equivalence of the scope of the claims are therefore to be embraced by the invention.

What is claimed is:

1. A cleaning method for a grinding chamber in a grinding apparatus including holding means for holding a workpiece and grinding means having a rotatable grinding wheel, the grinding wheel being composed of an annular base having an inner side surface and an outer side surface and a plurality of abrasive members fixed to the base and arranged annularly for grinding the workpiece held on the holding means, the holding means and the grinding means being provided in the grinding chamber, the cleaning method comprising:

a grinding water supplying step of supplying a grinding water at given flow rate from grinding water supplying means to the inner side surface of the base of the grinding wheel in the condition where the grinding wheel is being rotated; and a grinding chamber cleaning step of guiding the grinding water supplied by the grinding water supplying step along the inner side surface of the base to the abrasive members, introducing a part of the grinding water into a plurality of through holes formed in the base so as to extend from the inner side surface to the outer side surface at an upward angle away from the workpiece, by using a centrifugal force due to the rotation of the grinding wheel, and then scattering the grinding water from the plurality of through holes opening to the outer side surface, thereby cleaning the grinding chamber with the grinding water scattered.

* * * * *